United States Patent [19]

Carney, III

[11] Patent Number: 5,011,326

[45] Date of Patent: Apr. 30, 1991

[54] NARROW STATIONARY IMPACT ATTENUATION SYSTEM

[75] Inventor: John F. Carney, III, Nashville, Tenn.

[73] Assignee: State of Connecticut, Hartford, Conn.

[21] Appl. No.: 516,276

[22] Filed: Apr. 30, 1990

[51] Int. Cl.[5] ..... E01F 13/00; E01F 15/00

[52] U.S. Cl. ..... 404/6; 404/9

[58] Field of Search ..... 404/6, 12, 13, 9, 10; 256/1, 13.1; 188/371, 377

[56] References Cited

U.S. PATENT DOCUMENTS

| | | | |
|---|---|---|---|
| 3,141,655 | 7/1964 | Platt | 256/13.1 X |
| 3,643,924 | 2/1972 | Fitch | 256/13.1 |
| 3,674,115 | 7/1972 | Young et al. | 404/6 X |
| 3,680,662 | 8/1972 | Walker et al. | 404/6 X |
| 3,693,940 | 9/1972 | Kendall et al. | 404/6 X |
| 3,845,936 | 11/1974 | Boedecker, Jr. | 404/6 X |
| 3,848,853 | 11/1974 | Way et al. | 404/6 X |
| 3,856,268 | 12/1974 | Fitch | 404/6 X |
| 3,876,185 | 4/1975 | Welch | 404/6 X |
| 3,880,404 | 4/1975 | Fitch | 404/6 X |
| 3,944,187 | 3/1976 | Walker | 256/13.1 |
| 4,062,521 | 12/1977 | Moreau | 404/6 X |
| 4,066,244 | 1/1978 | Yoho | 404/6 X |
| 4,073,482 | 2/1978 | Seegmiller et al. | 404/6 X |
| 4,101,115 | 7/1978 | Meinzer | 404/6 X |
| 4,200,310 | 4/1980 | Carney, III | 293/132 X |
| 4,289,419 | 9/1981 | Young et al. | 404/6 |
| 4,290,585 | 9/1981 | Glaesener | 404/6 X |
| 4,407,484 | 10/1983 | Meinzer | 404/6 X |
| 4,452,431 | 6/1984 | Stephens et al. | 404/6 X |
| 4,552,341 | 11/1985 | Zucker et al. | 404/6 X |
| 4,557,466 | 12/1985 | Zucker | 404/6 X |
| 4,645,375 | 2/1987 | Carney, III | 404/6 |
| 4,688,766 | 8/1987 | Zucker | 404/6 X |
| 4,909,661 | 3/1990 | Ivey | 404/6 |

*Primary Examiner*—Ramon S. Britts
*Assistant Examiner*—Gay Ann Spahn
*Attorney, Agent, or Firm*—Arthur E. Fournier, Jr.

[57] ABSTRACT

A narrow stationary impact attenuation system (10) for reducing the severity of vehicular collisions occasioned by an errant vehicle striking an immovable object at narrow hazard sites. The subject narrow stationary impact attenuation system (10) includes crash cushion means (12), lateral stability means (14), backup means (16), support means (18), lateral deflection means (20), vehicle anti-vaulting means (22), redirection means (24), and base means (26). The lateral stability means (14) extends the length of the crash cushion means (12) on either side thereof. The backup means (16) is positioned in juxtaposed relation to the crash cushion means (12) at the rear thereof. The support means (18) is positioned in juxtaposed relation to the crash cushion means (12) at the front thereof. The lateral deflection means (20), the vehicle anti-vaulting means (22) and the redirection means (24) are each mounted in supported relation at selected positions relative to the crash cushion means (12). The base means (26) provides the pavement support for all of the components that collectively comprise the subject narrow stationary impact attenuation system.

11 Claims, 7 Drawing Sheets

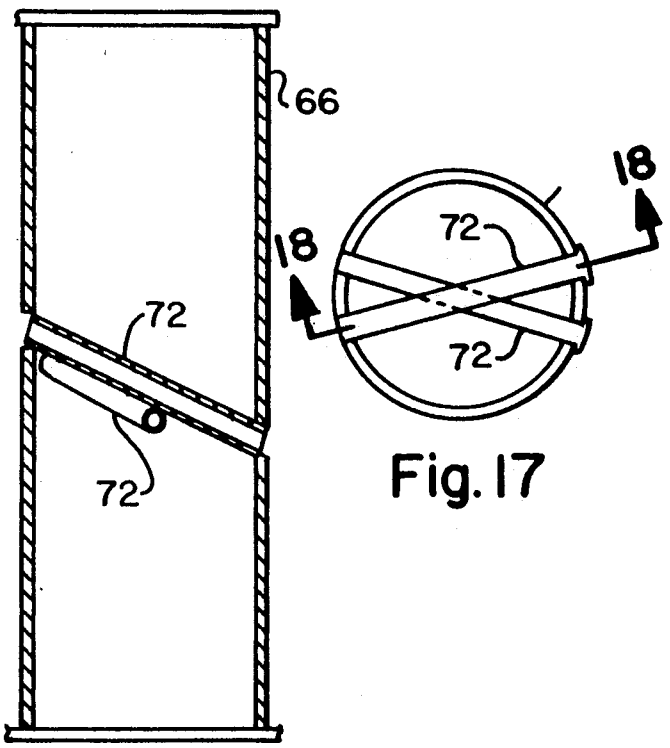
Fig. 17
Fig. 18
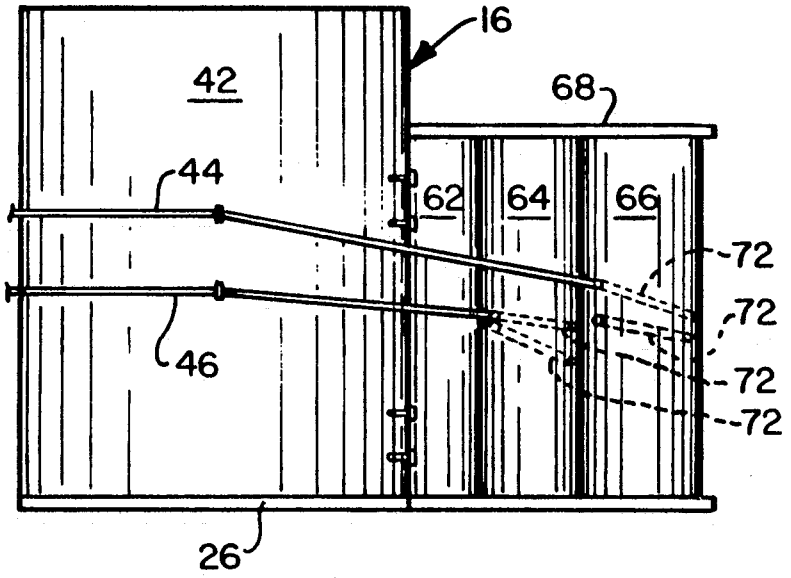
Fig. 16
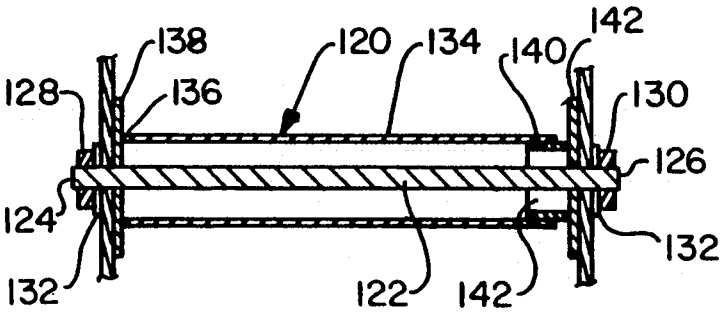
Fig. 15

NARROW STATIONARY IMPACT ATTENUATION SYSTEM

The United States Government has rights in this invention pursuant to an Agreement between the Connecticut Department of Transportation and the Federal Highway Administration.

BACKGROUND OF THE INVENTION

The present invention is directed to a stationary impact attenuation system, and more specifically to a form of stationary impact attenuation system which is particularly suited for use at narrow hazard sites, such as at the ends of edge-of-road and median barriers, bridge pillars and center piers, for purposes of reducing the severity of vehicular collisions, especially of the kind involving fast moving motor vehicles and stationary objects, in an effort to thereby limit the extent of injury suffered by people as a consequence of such vehicular collisions as well as the damage done as a consequence of such vehicular collisions to the vehicles and the objects struck thereby.

It has long been known in the prior art to employ accident preventative measures in an effort to prevent and/or reduce the damage incurred by both humans and property resulting from vehicular collisions occurring on the Nation's major highways as well as its local roads. Such accident preventative measures may be classified for purposes of this discussion into two basic categories; namely, warning devices designed to be operative to forestall the occurrence of a vehicular collision, and protective devices designed to afford protection to both persons and property in the event of the ocurrence of a vehicular collision.

By way of exemplification and not limitation, the category of warning devices is intended to include such items as conventional traffic signs and traffic signals, emergency signs and signals displayed to warn of the temporary existence of a dangerous situation, etc. Protective devices fall into two classes. In the first class are those devices embodied in a vehicle as part of the construction of the vehicle, irrespective of whether the latter are subsequently affixed in some manner to the exterior of the vehicle. Examples of protective devices, which fall within the first class, are such things as padded dashboards, seat belts, etc. In the second class are to be found such things as various types of safety barriers designed to afford protection in the event of a vehicular collision between a moving vehicle and another moving vehicle, or between a moving vehicle and an immovable object. The present invention relates to a protective device of the type falling within the second class thereof as defined hereinabove, and more specifically, to such a device which is designed to afford protection in the event of a collision between a moving vehicle and an immovable object.

That there exists along the Nation's major highways and along its local roads a potential for danger has long been known. In this regard, one such potential for danger which one often encounters while traveling along the Nation's major highways and its local roads is that of the hazardous conditions occasioned by the presence on such highways and roads of men and equipment engaged in highway and road maintenance and repair operations. Such personnel and equipment need to be protected from being struck by an errant moving vehicle. More specifically, what is needed to provide such protection is an energy absorbing barrier which is portable in nature.

Although a great deal of the focus of the prior art heretodate has been directed towards providing various kinds of stationary energy absorbing barriers, there is known to exist in the prior art at least two different types of portable energy absorbing barriers, the latter more commonly being viewed as comprising a system. One such portable energy absorbing system is in the form of a hydro-cell system and consists of five rows of thirteen polyvinyl chloride plastic cells enveloped in a corset-like membrane. The entire unit is mounted on a metal platform, which is designed to be attached to the rear of a highway service vehicle. Each cell contains approximately three and one-half gallons of a water-calcium chloride solution. The latter solution functions to provide the system with the desired controlled crushing characteristics. The hydro-cell portable energy absorbing system, although being portable in nature and relatively easy to install, has been found to suffer from the major disadvantage that it cannot simultaneously satisfy the energy absorption and minimum stopping distance, i.e., deceleration requirements, for moving vehicles impacting thereagainst at speeds in excess of thirty miles per hour.

Another known form of portable energy abdorbing system is the modular crash cushion system, which is composed of thirty steel drums, i.e., ten rows with three drums per row. The thirty drums rest on a trailer, which is designed to be attached to a highway service vehicle at five points to provide the required degree of horizontal and vertical stability during impact. The principal disadvantage of the modular crash cushion portable energy system stems from the fact that it is nineteen and one-half feet long. As a consequence, because of the need to maintain a rigid interconnection between the trailer and the towing service vehicle at all times, this system has been shown to suffer from severe wear limitations as concerns both the trailer on which the drums rest and the service vehicle which tows the trailer. In addition, because of its relatively long length, this system has proven to be unsuitable for use on the hilly and curved sections of highways and roads, which are found to exist in many areas of the country.

Yet another example of a prior art form of portable energy absorbing system, and one that has found favor with those who have a need forsuch systems, is that which forms the subject matter of U.S. Pat. No. 4,200,310, which issued on Apr. 29, 1980 to the same inventor as that of the present application and which is assigned to the same assignee as the present application. As described therein, the portable energy absorbing system, which is operable as an impact attenuation device for reducing the severity of vehicular collisions, comprises guidance frame means, energy absorbing means and impacting plate means. The guidance frame means, which is operable to secure one end of the energy absorbing system in fixed relation to a vehicle, includes an attachment plate through which the guidance frame means is fastened at one end to the aforesaid vehicle, structural tubing members having one end thereof secured to theattachment plate, first support means operable for supporting the structural tubing members and for securing the other end of the structural tubing members to the aforesaid vehicle, and reinforcing means mounted on the structural tubing members operable to provide additional strength to the structural tubing members. The energy absorbing means, which functions to absorb the energy released during the vehicular collisions, includes a multiplicity of pipe sections connected together in series relation and supported in interposed relation between the guidance frame means and the impacting plate means. The impacting means, which is the portion of the energy absorbing system designed to be struck during the vehicular collisions, includes a reinforced plate means, structural members having one end thereof supported in sliding relation within the structural tubing members of the guidance frame means, and second support means having one end fastened to the aforesaid vehicle operable to provide additional vertical support to the energy absorbing system relative to the aforereferenced vehicle.

Continuing with the discussion of the second class of protective devices as the latter has been defined hereinbefore, the nature of the immovable objects which are being referred to herein are such things as bridge piers, light stanchions, guardrails, signposts, concrete walls and abutments, etc. Typically, an attempt is made to provide protection against a moving vehicle striking such immovable objects by positioning a stationary traffic safety barrier in proximity to the immovable object and so that it lies along the path, which the moving vehicle would most likely follow if it were to strike the immovable object. Such stationary traffic safety barriers are most often intended to function in the manner of an impact attenuation device; namely, to attenuate the forces produced as a result of the impact of the moving vehicle striking the immovable object and thereby reduce the severity of the vehicular collision as relates to the extent of injury suffered by the individuals riding in the moving vehicle and the amount of property damage incurred by both the moving vehicle and the immovable object.

For ease of reference during the following discussion, such stationary traffic safety barriers will hereinafter be referred to as stationary energy absorbing barriers. One of the earliest attempts made at providing a stationary energy absorbing barrier involved the employment of a system composed of fifty-five gallon drums. Patterns were cut into the lids of the drums to reduce the crushing strength of the system, i.e., to provide the system with the desired controlled crushing characteristics.

The successful implementation of this fifty-five gallon drum modular crash cushion system prompted a study of the feasibility of employing other possible forms of stationary energy absorbing barriers. In this regard, corrugated steel pipe was found to have favorable characteristics when it was statically crash tested. Moreover, the availability of corrugated steel pipe having a wide range of thickness and diameter dimensions made it feasible to employ a polymodular design in which the physical characteristics of the stationary energy absorbing barrier could be varied on a row to row basis.

Examples of other forms of stationary energy absorbing barriers, which are known to exist in the prior art, include the following: a hydro cushion cell barrier composed of an array ofliquid filled plastic cells operable such that upon impact, the liquid is ejected through orifices in the top of the cells at a controlled rate; a barrier formed by an array of nine to seventeen sand-filled frangible plastic barrels, which is characterized by its versatile applicability; a U-shaped tubular guardrail energy absorbing barrier that absorbs energy by means of the motion of supporting telescopic tubes such that upon impact, the impact forces are transmitted axially to arms, which contain many stainless steel torus elements that are squeezed between two cylindrical tubes; a barrier in the form of a vehicle arresting system that is composed of a steel entrapping net positioned across a roadway, and which is particularly applicable for use in proximity to locations such as road dead ends, fery landings, highway medians at bridge overpasses, etc.; a lightweight cellular concrete crash cushion barrier constructed of easily frangible vermiculite concrete with vertical voids wherein the vertical voids contribute to the controlled crushing characteristics of the barrier; honeycomb cells that are filled with polyurethane foam; in other instances the honeycomb cells are themselves made of aluminum; for use primarily as part of a guardrail system, a barrier based on a fragmenting tube concept, which was originally developed for use in planned lunar landing modules, and in which energy is absorbed by forcing a thick walled aluminum tube over a flared die, resulting in the shredding of the tube into small segments; and lastly, an energy absorbing barrier particularly applicable for use as part of a guardrail system and in which thick walled steel rings are utilized.

Yet another example of a prior art form of stationary energy absorbing barrier, and one that has found favor with those who have a need for such systems, is that which forms the subject matter of U.S. Pat. No. 4,645,375, which issued on Feb. 24, 1987 to the same inventor as that of the present application and which is assigned to the same assignee as the present application. As described therein, the stationary energy absorbing barrier. which is operable for reducing the severity of vehicular collisions occasioned by an errant vehicle striking an immovable object including support means, impact attenuating means and protective means. The support means is located in juxtaposed relation to an immovable object and so as to lie between the immovable object and an oncoming errant vehicle. The impact attenuating means is positioned in supported relation on the support means and is selectively operative to entrap an errant vehicle striking the stationary energy absorbing barrier at a second location. The protective means is positioned in juxtaposed relation to the impact attenuating means and is operative to prevent the buildup of snow and ice on the other components that comprise the stationary energy absorbing barrier.

In summary, the favorable energy dissipation capabilities of laterally loaded metallic cylinders, i.e., "crash cushions", have led to their widespread employment in impact attenuation devices used in highway safety applications. These crash cushions have included both portable and stationary devices. In both systems, energy is dissipated by deforming mild steel cylinders inelastically to deformations approaching ninety (90) percent of their original outside diameters under high speed impacts, e.g., sixty (60) miles per hour (mph), with heavy vehicles, e.g., vehicles weighing 4500 pounds (lbs.). The portable system preferably is emplaced in slow-moving maintenance operations, e.g., line-striping, to provide protection for both the errant motorist and maintenance personnel. The stationary system known as the Connecticut Impact Attenuation System (CIAS), which forms the subject matter of the aforementioned U.S. Pat. No. 4,645,375, is composed of fourteen (14) mild steel cylinders of three (3) or four (4) foot diameters such that at its base the CIAS is approximately twelve (12) feet in width. All of the cylinders in the CIAS are four feet high, but the individual wall thicknesses vary from cylinder to cylinder. The CIAS is unique in that it will trap the errant vehicle when the vehicle impacts the CIAS on the side unless the area of the impact on the CIAS is so close to the back of the CIAS that significant energy dissipation and acceptable deceleration responses are unobtainable because of the proximity of the hazard. Only in this situation will the CIAS redirect the vehicle back into the traffic flow direction. In order to cope with this need for the CIAS to redirect the vehicle back into the traffic flow direction when a vehicle impacts the CIAS near the rear thereof, steel "tension" straps, which are ineffective under compressive loading, and "compression" pipes, which are ineffective in tension, are employed. This bracing structure that the CIAS embodies ensures that the CIAS will respond in a stiff manner when subjected to an oblique impact near the rear of the CIAS, providing the necessary lateral force to redirect the errant vehicle. On the other hand, the braced tubes of the CIAS retain their unstiffened responses when the cylinders of the CIAS are crushed by impacts away from the back of the CIAS. The CIAS is being employed in several states in the United States. It has been credited with saving lives and greatly reducing the severities of injuries associated with high speed accidents by reducing the deceleration levels of the occupants.

Notwithstanding the effectiveness that the CIAS has demonstrated in reducing the severities of injuries associated with high speed encounters between errant vehicles and immovable objects, a need has nevertheless been evidenced for a new and improved form of stationary impact attenuation system, and in particular a new and improved form of stationary impact attenuation system that would be at least as effective as the CIAS in reducing the severity of injuries occasioned by high speed encounters between errant vehicles and immovable objects, but unlike the CIAS would be capable of being employed at narrow hazard sites. Examples of such narrow hazard sites include the ends of edge-of-road and median barriers, bridge pillars, and center piers. In order to be capable of use in such narrow hazard sites, such a new and improved stationary impact attenuation system must not exceed approximately three (3) feet in width as contrasted to the CIAS which at its base is approximately twelve (12) feet in width. There are a number of characteristics, which it is desired that such a new and improved narrow stationary impact attenuation system should possess. Namely, such a narrow stationary impact attenuation system should be operative to trap the errant vehicle when struck headon by an errant vehicle weighing up to 4500 lbs. that is traveling at a speed of up to sixty (60) mph when the narrow stationary impact attenuation system is struck thereby. On the other hand, the narrow stationary impact attenuation system should be operative to redirect the errant vehicle into the traffic flow direction when the narrow stationary impact attenuation system is struck other than headon by an errant vehicle weighting up to 4500 lbs. that is traveling at a speed of up to sixty (60) mph when the narrow stationary impact attenuation system is struck thereby. In addition, the narrow stationary impact attenuation system should be capable of satisfying the applicable performance standards as outlined in NCHRP Report 230. Moreover, the narrow stationary impact attenuation system should be capable of being constructed from readily available materials, and should be inexpensive to repair after having been struck by an errant vehicle. Also, use of the narrow stationary impact attenuation system should not be unduly limited because of considerations of terrrain, etc. Finally, the narrow stationary impact attenuation system should be characterized by the fact that when struck by an errant vehicle there is no flying debris associated with the crash event.

It is, therefore, an object of the present invention to provide a new and improved form of stationary impact attenuation system operable to reduce the severity of vehicular collisions with immovable objects.

It is another object of the present invention to provide such a stationary impact attenuation system, which is particularly suited for employment as a stationary system at narrow hazard sites to afford protection to immovable objects from otherwise being struck by an errant vehicle.

A further object of the present invention is to provide such a narrow stationary impact attenuation system, which is operative when struck headon by an errant vehicle weighing up to 4500 lbs. and traveling at a speed of up to sixty (60) mph to entrap the errant vehicle striking the system.

A still further object of the present invention is to provide such a narrow stationary impact attenuation system, which is operative other than when struck headon by an errant vehicle weighing up to 4500 lbs. and traveling at a speed of up to sixty (60) mph to redirect the errant vehicle striking the system into the traffic flow direction.

Yet another object of the present invention is to provide such a narrow stationary impact attenuation system which is capable of satisfying the applicable impact performance standards as outlined in NCHRP Report 230.

Yet still another object of the present invention is to provide such a narrow stationary impact attenuation system, the use of which is not unduly limited because of considerations of terrain, etc.

Yet a further object of the present invention is to provide such a narrow stationary impact attenuation system which is characterized by the fact that when struck by an errant vehicle there is no flying debris associated with the crash event.

Yet a still further object is to provide such a narrow stationary impact attenuation system which is capable of being constructed of readily available materials, and is inexpensive to repair after having been struck by an errant vehicle.

SUMMARY OF THE INVENTION

In accordance with the present invention there is provided a new and improved stationary impact attenuation system which is particularly suited for use as a narrow stationary impact attenuation system to reduce the severity of injuries occasioned by high speed encounters at narrow hazard sites between errant vehicles and immovable objects. The subject narrow stationary impact attenuation system comprises crash cushion means, lateral stability means, backup means, support means, lateral deflection means, vehicle anti-vaulting means, redirection means and base means. The crash cushion means comprises a multiplicity of cylindrical members that are of predetermined width and of different preselected thicknesses. The lateral stability means comprises a plurality of cable-like members that are suitably connected to and which extend the length of the crash cushion means on either side thereof. The backup means comprises a tubular structure which is positioned at the rear of the crash cushion meaqns as a backup support thereto, and also to provide support for the lateral stability means at one end thereof. The support means comprises a plurality of lateral deflection limiters which are cooperatively associated with selected ones of the multiplicity of cylindrical members of the crash cushion means and which are operative to limit the amount of lateral deflection in the subject narrow stationary impact attenuation system. The vehicle anti-vaulting means comprises a plurality of box-beam members and tension members which are cooperatively associated with selected ones of the multiplicity of cylindrical members of the crash cushion means and which are operative to prevent an erant vehicle striking the subject narrow stationary impact attenuation system headon from vaulting over the crash cushion means or submarining under the crash cushion means. The redirection means comprises a plurality of compression members and a compression-tension member that are cooperatively associated with selected ones of the multiplicity of cylindrical members of the crash cushion means and which are operative to aid in combination with the aforedescribed lateral stability means and lateral deflection means to redirect into the traffic flow direction an errant vehicle which strikes the side of the subject narrow stationary impact attenuation system. Finally, the base means comprises the pavement support upon which the subject narrow stationary impact attenuation system rests.

BRIEF DESCRIPTION OF THE DRAWING

FIG. 15 is a side elevational view partially in section of a stiffening member that is utilized for stiffening purposes in a selected one of the multiplicity of cylindrical members that collectively comprise the crash cushion of a narrow stationary impact attenuation system constructed in accordance with the present invention;

FIG. 16 is a side elevational view of the backup structure which is employed in a narrow stationary impact attenuation system constructed in accordance with the present invention;

FIG. 17 is a plan view of one of the pipe-like members of the backup structure which is employed in a narrow stationary impact attenuation system constructed in accordance with the present invention;

FIG. 18 is a cross-sectional view taken along the line 18—18 in FIG. 17 of one of the pipe-like members of the backup structure which is employed in a narrow stationary impact attenuation system constructed in accordance with the present invention.

DESCRIPTION OF A PREFERRED EMBODIMENT

Figure 2:
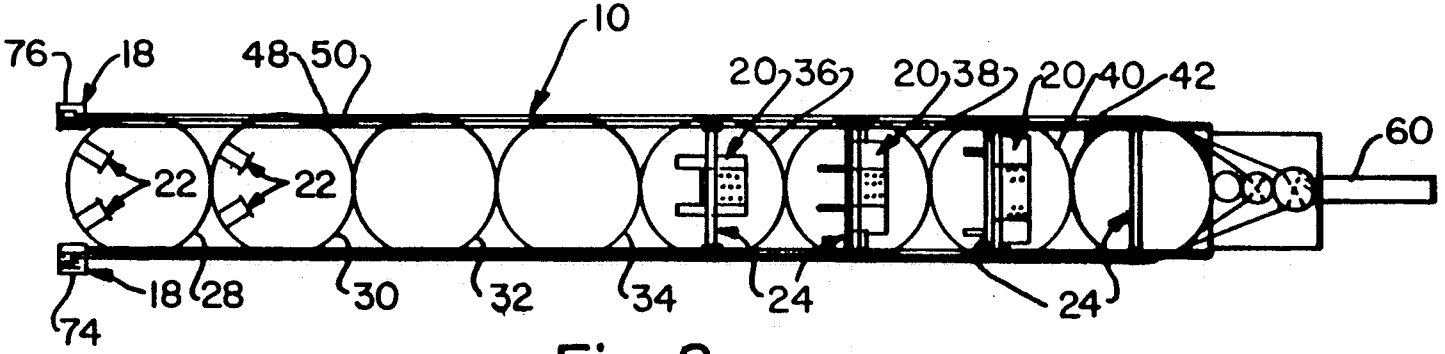
FIG. 2 is a plan view of a narrow stationary impact attenuation system constructed in accordance with the present invention.
Figure 1:
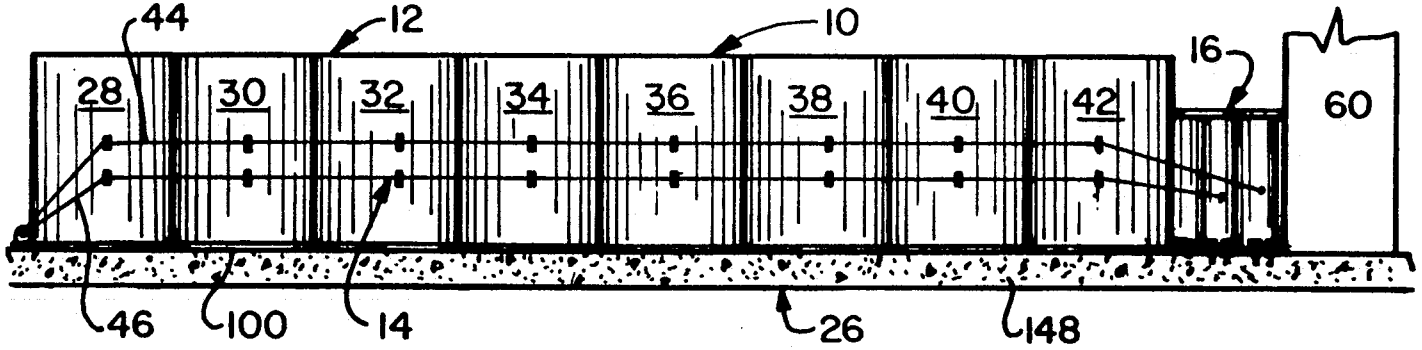
FIG. 1 is a side elevational view of a narrow stationary impact attenuation system constructed in accordance with the present invention.

Referring now to the drawing, and more particularly to FIGS. 1 and 2 thereof, there is illustrated therein a narrow stationary impact attenuation system, generally designated by the reference numeral 10, constructed in accordance with the present invention. When deployed in the manner shown in FIGS. 1 and 2, the narrow stationary impact attenuation system 10 is designed to be operative to reduce the severity of vehicular collisions occasioned by an errant vehicle striking an immovable object at narrow hazard sites. To this end, depending upon the point at which the errant vehicle impacts the narrow stationary impact atenuation system 10, the impacting vehicle will, in a manner yet to be described, either be entrapped by the narrow stationary impact attenuation system 10 or be redirected by the narrow stationary impact attenuation system 10. The narrow stationary impact attenuation system 10 preferably is positioned at the narrow hazard site in front of the immovable object and in juxtaposed relation thereto such that the narrow stationary impact attenuation system 10 lies between the immovable object and an oncoming errant vehicle.

As best understood with reference to FIGS. 1 and 2 of the drawing, the narrow stationary impact attenuation system 10 in accord with the best mode embodiment of the invention is composed of a number of major components; namely, crash cushion means, generally designated by the reference numeral 12; lateral stability means, generally designated by the reference numeral 14; backup means, generally designated by the reference numeral 16; support means, generally designated by the reference numeral 18; lateral deflection means, generally designated by the reference numeral 20; vehicular anti-vaulting means, generally designated by the reference numeral 22; redirection means, generally designated by the reference numeral 24; and base means, generally designated by the reference numeral 26. It is important to note here that in order to ensure that the narrow stationary impact attenuation system 10 possesses the desired impact attenuating characteristics, it is essential that there exists a predetermined interrelationship between all of the major components that have been enumerated hereinabove and dof which the narrow stationary impact attenuation system 10 is composed. The nature of this interelationship will be described more fully subsequently.

A detailed description will now be had of each of the major components that have been enumerated hereinbefore and of which the narrow stationary impact attenuation system 10 is composed commencing with the crash cushion means 12. For this purpose, reference will be had in particular to FIGS. 1 and 2 of the drawing. When constructed as shown in FIGS. 1 and 2 of the drawing, the crash cushion means 12 is designed to be operative to attenuate the impact caused by an errant vehicle striking the narrow stationary impact attenuation system 10. To accomplish this, the crash cushion means 12 in accordance with the best mode embodiment of the invention is composed of a multiplicity of cylindrical members that are suitably arranged in a single row.

Continuing, as best understood with reference to FIGS. 1 and 2 of the drawing, the multiplicity of cylindrical members in accordance with the best mode embodiment of the invention consists of eight cylindrical members, denoted by the reference numerals 28, 30, 32, 34, 36, 38, 40 and 42, respectively, that are positioned in abutting relation one to another in a single row. Preferably, all of the cylindrical members 28, 30, 32, 34, 36, 38, 40 and 42 are formed from flat plate stock and are each three feet in diameter and four feet high. On the other hand, the cylindrical members 28, 30, 32, 34, 36, 38, 40 and 42 are of different thicknesses. Namely, cylindrical member 28 has a wall thickness of ⅛ inch, cylindrical member 30 has a wall thickness of 3/16 inch, cylindrical members 32, 34, 36 and 42 each have a wall thickness of ¼ inch, cylindrical member 38 has a wall thickness of 5/16 inch, and cylindrical member 40 has a wall thickness of ⅜ inch. It should thus be readily apparent that by virtue of the fact that the crash cushion means 12 is composed of eight cylindrical members 28, 30, 32, 34, 36, 38, 40 and 42 which are each three feet in diameter the total length of the crash cushion means 12 is, therefore, twenty-four feet whereas the width thereof is only three feet. In terms of length, the twenty-four feet which the crash cushion means 12 embodies is considered to be the minimum acceptable length that the crash cushion means 12 could have if the crash cushion means 12 is to be capable of meeting the crash test requirements that are set forth in NCHRP Report 230. In this connection, it is important to point out herein once again that the use on our Nation's highways of the narrow stationary impact attenuation system 10 which forms the subject matter of the present invention is dependent upon the narrow stationary impact attenuation system 10 being able to meet the crash test requirements that are promulgated in NCHRP Report 230. While with regard to the width of the crash cushion means 12, being three feet in width the crash cushion means 12 is slightly wider, which is as it should be, than most narrow highway hazards such as the ends of edge-of-road and median barriers, bridge pillars, and center piers which generally are found to be approximately two feet in width.

A description will now be had herein of the lateral stability means 14. For this purpose, reference in particular will be had once again to FIGS. 1 and 2 of the drawing. In a manner which will be described more fully hereinafter the lateral stability means 14 is designed to be operative to provide a dual function. First, the lateral stability means 14 is designed to be operative to provide lateral stability to each of the multiplicity of cylindrical members 28,30,32,34,36,38,40 and 42 which collectively comprise the crash cushion means 12 and thus thereby also to the narrow stationary impact attenuation system 10. Secondly, the lateral stability means 14 is also designed to be operative in association with both the lateral deflection means 20 and the redirection means 24 to assist in redirecting errant vehicles into the traffic flow direction when the narrow stationary impact attenuation system 10, which forms the subject matter of the present invention, is struck by such errant vehicles under side impact conditions.

Continuing on with the description thereof, the lateral stability means 14 in accordance with the best mode embodiment of the invention consists of four steel cables, denoted by the reference numerals 44,46,48 and 50, respectively. Preferably, each of the steel cables 44,46,48 and 50 is one inch in diameter. The cables 44,46,48 and 50 are attached to the multiplicity of cylindrical members 28,30,32,34,36,38,40 and 42 with two of the cables 44,46,48 and 50 being positioned on either side of the crash cushion means 12 so as to extend in parallel relation one above the other for the full length of the crash cushion means 12 and for substantially the entire length of the narrow stationary impact attenuation system 10. The cables 44,46,48 and 50 may be attached to the multiplicity of cylindrical members 28,30,32,34,36,38,40 and 42 through the use of any convential form of attachment means that is suitable for use for such a purpose.

Figure 4:
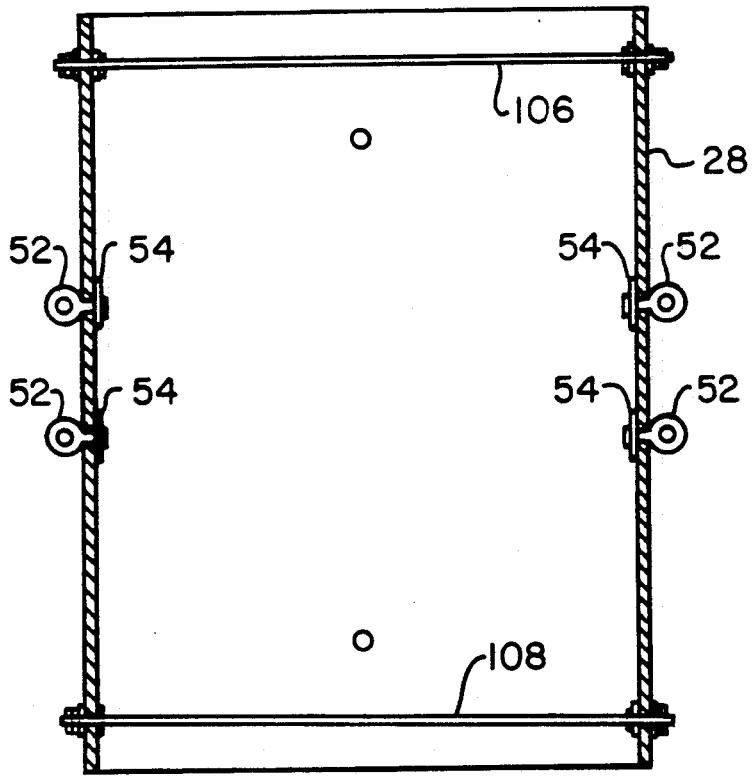
FIG. 4 is a cross-sectional view taken along the line 4—4 in FIG. 3 of one of the multiplicity of cylindrical members that collectively comprise the crash cushion of a narrow stationary impact attenuation system constructed in accordance with the present invention.
Figure 5:
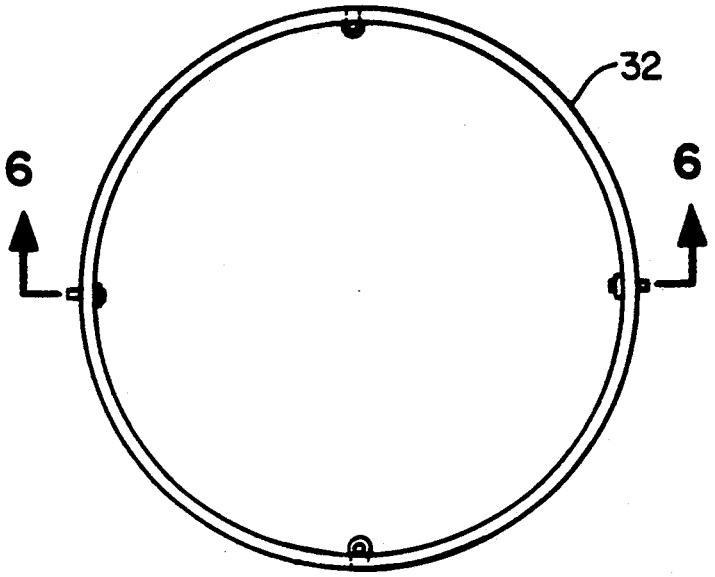
FIG. 5 is a plan view of another one of the multiplicity of cylindrical members that collectively comprise the crash cushion of a narrow stationary impact attenuation system constructed in accordance with the present invention.

One such form of attachment means which may be employed for this purpose is that which is seen in FIG. 4 of the drawing wherein there is depicted in cross-section the cylindrical member 28. As illustrated in FIG. 4, the attachment means comprises a plurality of eyebolts;

namely four eyebolts, each denoted by the same reference numeral 52 such that one eyebolt 52 is provided for each one of the four cables 44,46,48 and 50. Each of the eyebolts 52 in known fashion is made to pass through an opening suitably provided for this purpose in the sidewall of the cylindrical member 28 such that the free end of each of the eyebolts 52 projects into the interior of the cylindrical member 28. In turn, this free end is threaded into a backup plate 54 that is suitably provided for this purpose such that when so threaded therein the backup plate 54 is positioned in juxtaposed relation to the inner surface of the sidewall of the cylindrical member 28. In accordance with the best mode embodiment of the invention, attachment means in the form of eyebolts 52 and backup plate 54 are utilized with each of the cylindrical member 42.

Figure 6:
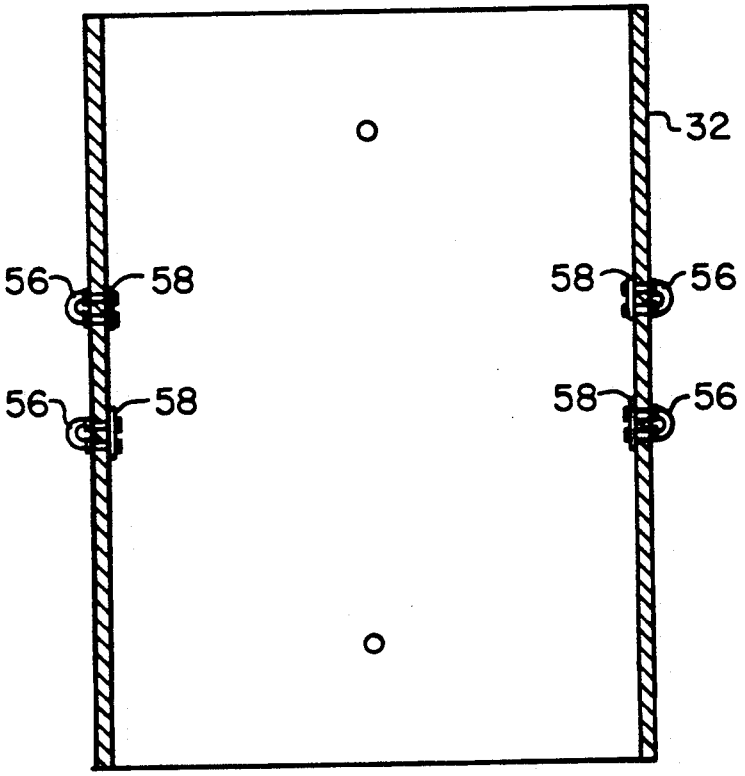
FIG. 6 is a cross-sectional view taken along the line 6—6 in FIG. 5 of another one of the multiplicity of cylindrical members that collectively comprise the crash cushion of a narrow stationary impact attenuation system constructed in accordance with the present invention.
Figure 7:
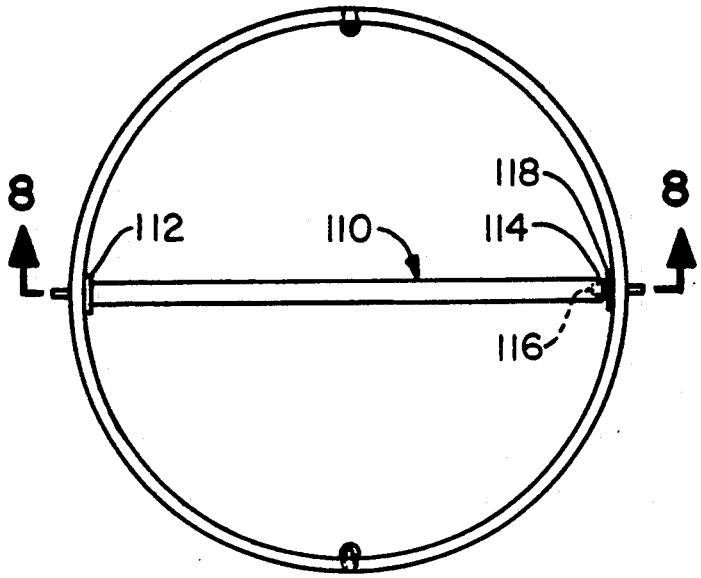
FIG. 7 is a plan view of yet another one of the multiplcity of cylindrical members that collectively comprise the crash cushion of a narrow stationary impact attenuation system constructed in accordance with the present invention.

Another form of attachment means through which the cables 44,46,48 and 50 may be attached to the cylindrical members 28,30,32,34,36,38,40 and 42 is that which can be seen in FIG. 6 of the drawing wherein there is depicted in cross-section the cylindrical member 32. As illustrated in FIG. 6, the attachment means comprises a plurality of U-bolts; namely, four U-bolts, each denoted by the same reference numeral 56 such that one U-bolt 56 is provided for each of the four cables 44,46,48 and 50. Each of the U-bolts 56 in known fashion is made to pass through an opening suitably provided for this purpose in the sidewall of the cylindrical member 32 such that the free end of each of the U-bolts 56 projects into the interior of the cylindrical member 32. In turn, these free ends are made to pass through a bracket 58 and are thereafter threaded in known fashion into a pair of conventional nuts (not shown) that are suitably provided for this purpose such that when so threaded into the aforementioned nuts the bracket 58 is positioned in juxtaposed relation to the inner surface of the sidewall of the cylindrical member 32. In accordance with the best mode embodiment of the invention attachment means in the form of U-bolts 56, brackets 58 and nuts (not shown) are utilized with each of the cylindrical members 30,32,34,36,38 and 40.

There will now be set forth herein a description of the backup means 16. For purposes of this description, reference will be had in particular to FIGS. 1,16,17 and 18 of the drawing. Thus, turning first to FIG. 1 of the drawing, as best understood with reference thereto, the backup means 16 in accord with the illustrated embodiment of the invention is positioned at the rear of the narrow stationary impact attenuation system 10 in such a manner as to be located in abutting engagement with cylindrical member 42 of the crash cushion means 12 and so as to be interposed between the cylindrical member 42 and a hazard, such as, for example, the end of a median barrier, which is by way of exemplification and not limitation depicted in FIGS. 1 and 2 of the drawing wherein the median barrier is denoted by the reference numeral 60, that the narrow stationary impact attenuation system 10 is intended to protect. The backup means 16 is designed to be operative to perform dual functions. Namely, the backup means 16 is designed to be operative to provide backup support for the crash cushion means 12 at the rear thereof. In addition, the backup means 16 is also operative to provide support for the ends of the four cables 44,46,48 and 50. To this end, the support provided by the backup means 16 takes the form of that which is necessary for the cables 44,46,48 and 50 to develop the tension required thereby in order to effect the redirection of errant vehicles into the traffic flow direction when the narrow stationary impact attenuation system 10 is struck under side impact conditions by such errant vehicles.

Continuing with the description thereof, the backup means 16, as best seen with reference to FIG. 16 of the drawing, consists of a plurality of pipe-like members, denoted by the reference numerals 62,64 and 66, respectively, and a top plate-like member, denoted by the reference 68. More specifically, in accord with the best mode embodiment of the invention the aforementioned plurality of pipe-like members 62,64 and 66 of backup means 16 comprise three in number and preferably are each made of steel. Moreover, preferably the pipe-like member 62 embodies a six-inch diameter, the pipe-like member 64 an eight-inch diameter and the pipe-like member 66 a ten-inch diameter. The pipe-like member 64 is suitably secured to both the pipe-like member 62 and the pipe-like member 66 through the use of any conventional form of securing means such as by being welded thereto for preferably the full length thereof on either side of the point of engagement of the pipe-like member 64 with the pipe-like member 62 and on either side of the point of engagement of the pipe-like member 64 with the pipe-like member 66. Turning next to the top plate-like member 68, in accord with the best mode embodiment of the invention the top plate-like member 68 is preferably made of steel and is one-half inch thick. Further, the top plate-like members 62 and 64 through the use of any conventional form of securing means such as by being welded thereto. Completing the description of the nature of the construction of the backup means 16, each of the pipe-like members 64 and 66 is suitably provided with cableways which for ease of identification and further description herein are each denoted by the same reference numeral, i.e., reference numeral 72. In accord with the best mode embodiment of the invention, each of the cableways 72 preferably takes the form of a steel pipe which is two inches in diameter and is supported through the use of any suitable form of conventional supporting means such as to traverse the interior from the exterior on one side to the exterior on the other side of the respective one of the pipe-like members 64 and 66 with which a particular one of the cableways 72 is cooperatively associated. As it should be readily apparent, the function of the cableways 72 is to enable the cables such as those denoted by the reference numerals 44 and 46 which extend the entire length of the crash cushion means 12 on one side to pass through the cableways 72 and to be secured in place such as by having the free end of the respective one of the cables 44,46,48 and 50 threaded into a conventional nut (not shown) suitable for use for such a purpose.

There will now be set forth herein a description of the support means 18. In acord with the best mode embodiment of the invention, the support means 18 consists of a pair of steel plate cable support members, which are denoted by the reference numerals 74 and 76, respectively, in FIG. 2 of the drawing. Each of the plate support members 74 and 76 is suitably provided at the front of the narrow stationary impact attenuation system 10 in close proximity to the front of the cylindrical member 28 of the crash cushion means 12 and with the plate support member 74 being positioned on one side thereof and with the other plate support member, i.e., plate support member 76, being positioned on the other side thereof. Moreover, the plate support members 74 and 76 are each preferably fastened to the base means 26 through the use of any conventional form of fastening means such as a plurality of conventional fateners (not shown in the drawing in the interest of maintaining clarity of illustation therein). Each of the pair of plate support means 74 and 76 has the ends of a pair of the cables 44, 46, 48 and 50 of the lateral stability means 14 suitably secured thereto in any conventional manner. Namely, as depicted in FIG. 2 of the drawing, in accord with the best mode embodiment of the invention the ends of the cables 44 and 46 are suitably secured to the plate support means 74 while the ends of the cables 48 and 50 are suitably secured to the plate support member 76 such as to ensure that the four cables 44, 46, 48 and 50 develop the tension required thereof in order to effect the redirection of errant vehicles into the traffic flow direction when the narrow stationary impact attenuation system 10 is struck under side impact conditions by such errant vehicles.

A description will next be had herein of the lateral deflection means 20. For this purpose, reference will be had in particular to FIGS. 2, 11, 12, 13 and 14 of the drawings. In accordance with the best mode embodiment of the invention, the lateral deflection means 20 is cooperatively associated with the cylindrical members 36, 38 and 40 of the crash cushion means 12. More specifically, the lateral deflection means 20 consists of a plurality of lateral deflection limiters. Namely, each of the cylindrical members 36, 38 and 40 has cooperatively associated therewith a lateral deflection limiter which is designed to be operative to limit the amount of lateral deflection in the cylindrical members 36, 38 and 40 and thereby also in the crash cushion means 12 and thus in the narrow stationary impact attenuation system 10 as well. In addition, the lateral deflection means 20 is further operative to assist in the redirection into the traffic flow direction of errant vehicles which strike the narrow stationary impact attenuation system 10 under side impact conditions.

Figure 12:
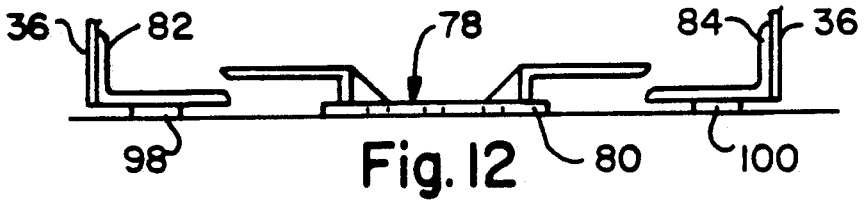
FIG. 12 is a side elevational view of the form of retainer that is depicted in FIG. 11 which is utilized for retaining on a base a selected one of the multiplicity of cylindrical members that collectively comprise the crash cushion of a narrow stationary impact attenuation system constructed in accordance with the present invention.
Figure 11:
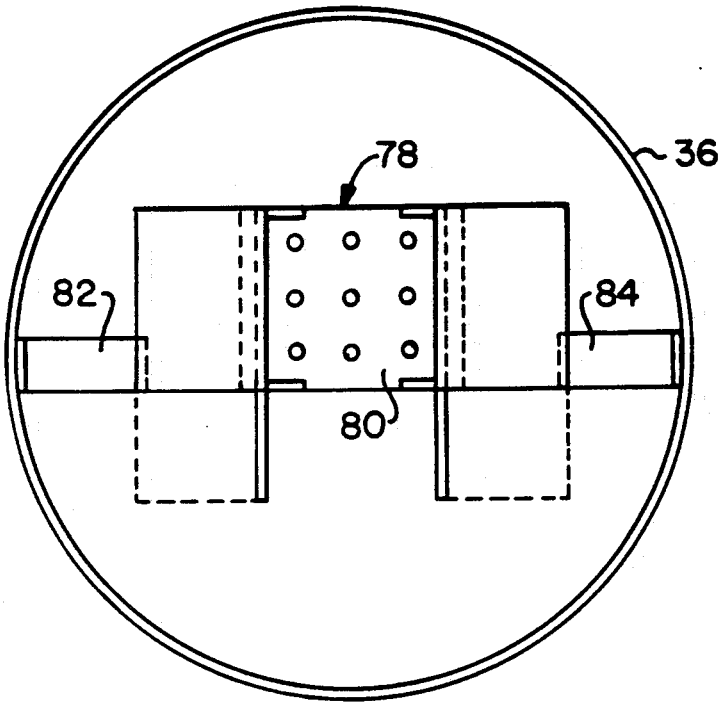
FIG. 11 is a plan view of one form of retainer which is utilized for retaining on a base a selected one of the multiplicity of cylindrical members that collectively comprise the crash cushion of a narrow stationary impact attenuation system constructed in accordance with the present invention.

Continuing, a description will now be had of the lateral deflection limiter which is cooperatively associated with the cylindrical members 36, 38 and 40. With particular reference to FIGS. 11 and 12 of the drawing, each of the cylindrical members 36 and 38 has cooperatively associated therewith a lateral deflection limiter, generally denoted by the reference numeral 78, which includes a plate-like member 80 that is suitably fastened to the base means 26 by means of any fasteners (not shown in the drawing in the interest of maintaining clarity of illustration therein) as well as a pair of upstanding clip-like members 82 and 84. Each of the pair of upstanding clip-like members 82 and 84 is suitably secured to theinterior surface of the cylindrical members 36 and 38 in the manner depicted in the case of the cylindrical member 36 in FIGS. 11 and 12 of the drawing such as by being welded thereto. Further, as best understood with reference to FIG. 12 of the drawing each of the upstanding clip-like members 82 and 84 rests on a skid rail, which is denoted in FIG. 12 of the drawing by the reference numerals 86 and 88, respectively.

Figure 14:
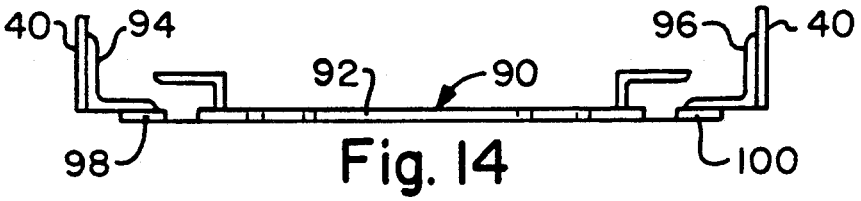
FIG. 14 is a side elevational view of the form of retainer that is depicted in FIG. 13 which is utilized for retaining on a base a selected one of the multiplicity of cylindrical members that collectively comprise the crash cushion of a narrow stationary impact attenuation system constructed in accordance with the present invention.
Figure 13:
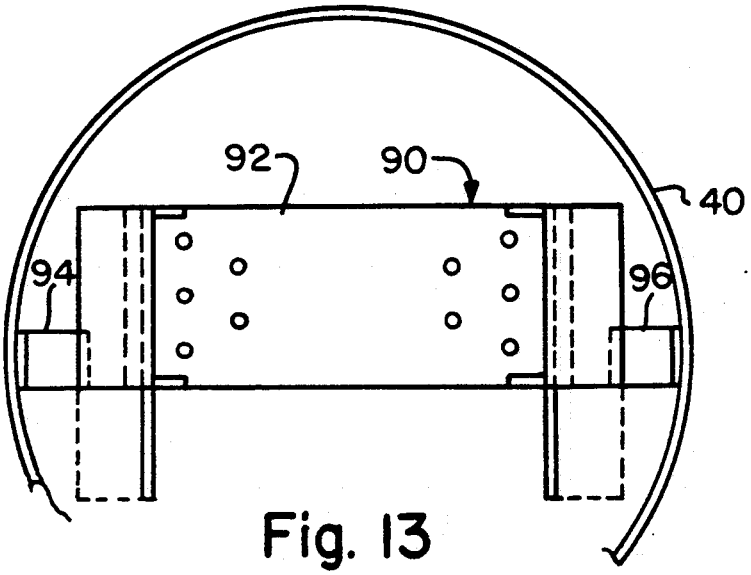
FIG. 13 is a plan view of another form of retainer which is utilized for retaining on a base a selected one of the multiplicity of cylindrical members that collectively comprise the crash cushion of a narrow stationary impact attenuation system constructed in accordance with the present invention.

Referring next to FIGS. 13 and 14 of the drawing, the cylindrical member 40 has cooperatively associated therewith a laterral deflection limiter, generally denoted by the reference numeral 90, which includes a plate-like member 92 that is suitably fastened to the base means 26 by means of any conventional form of fastening means such as a plurality of fasteners (not shown in the drawing in the interest of maintaining clarity of illustration therein) as well as a pair of upstanding clip-like members 94 and 96. Each of the pair of upstanding clip-like members 94 and 96 is suitably secured to the interior of the cylindrical member 40 in the manner depicted in FIGS. 13 and 14 of the drawing such as by being welded thereto. Further, as best understood with reference to FIG. 14 of the drawing each of the upstanding clip-like members 94 and 96 rests on a skid rail, which is denoted in FIG. 14 of the drawing by the reference numerals 98 and 100, respectively.

Figure 3:
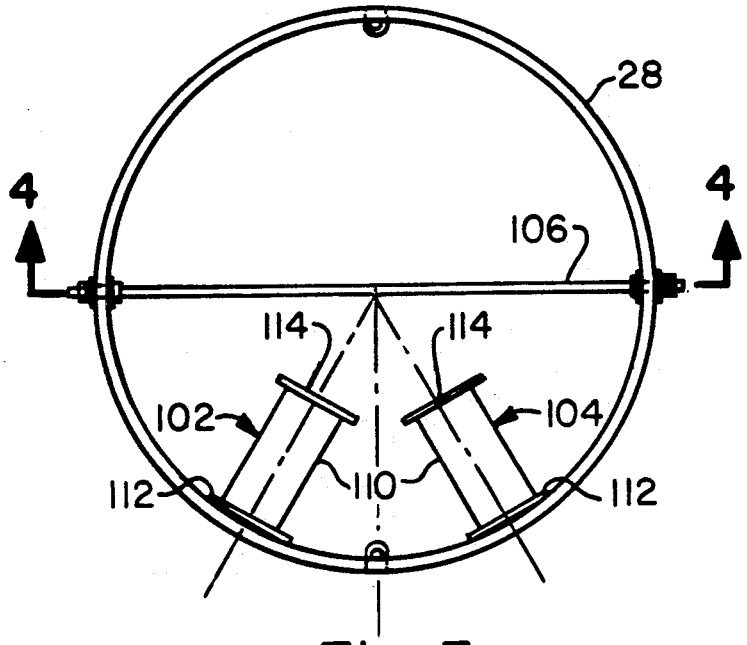
FIG. 3 is a plan view of one of the multiplicity of cylindrical members that collectively comprise the crash cushion of a narrow stationary impact attenuation system constructed in accordance with the present invention.

Now there will be set forth herein a description of the vehicle anti-vaulting means 22 of the narrow stationary impact attenuation system 10. Reference will be had in particular to FIGS. 1, 3 and 4 of the drawing for this purpose. As has been set forth herein previously, the function of the vehicle anti-vaulting means 22 is to prevent an errant vehicle which strikes the narrow stationary impact attenuation system 10 headon from vaulting over the crash cushion means 12 of the narrow stationary impact attenuation system 10 or from submarining under the crash cushion means 12 of the narrow stationary impact attenuation system 10. To this end, the vehicle anti-vaulting means 22 is designed to be operative when an errant vehicle strikes the cylindrical member 28 of the crash cushion means 12 of the narrow stationary impact attenuation system 10 headon to cause the cylindrical member 28 to wrap itself vertically around the front end of the errant vehicle impacting thereagainst, thereby effectively capturing the subject errant vehicle.

Continuing with the description thereof, the vehicle anti-vaulting means 22 consists of a pair of box beam stops, denoted generally by the reference numerals 102 and 104, respectively, with which each of the cylindrical members 28 and 30 is suitably provided in a manner to be described hereinafter and a pair of tension rods, denoted by the reference numerals 106 and 108, respectively, with which the cylindrical member 28 is also suitably provided in a manner yet to be described. More specifically, the box beam stops 102 and 104 with which each of the cylindrical members 28 and 30 is provided are suitably secured to the inner surface on opposite sides of the centerline of each of the cylindrical members 28 and 30 such that the box beam stops 102 and 104 extend at approximately a 30 degree angle to the centerline of the cylindrical members 28 and 30. For this purpose, the centerline of each of the cylindrical members 28 and 30 is defined to be the centerline of the crash cushion means 12 of the narrow stationary impact attenuation system 10. Any conventional form of securing means suitable for use for securing the box beam stops 102 and 104 to the inner surface of the cylindrical members 28 and 30 may be utilized for this purpose.

In accord with the best mode embodiment of the invention, each of the box beam stops 102 and 104 consists of a box beam, denoted by the reference numeral 110, which preferably is four inches by four inches by three-sixteenth inch and which is provided at either end thereof with a plate, denoted by the reference numerals 112 and 114, respectively, which preferably is six inches by six inches by three-eighth inch. Each of the tension rods 106 and 108 of the vehicle anti-vaulting means 22 with which the cylindrical member 28 is provided comprises in accord with the best mode embodiment of the invention a steel rod of one-half inch diameter. The tension rods 106 and 108 are suitably secured in place within the cylindrical member 28 through the use of any suitable form of securing means such as conventional fasteners suitably threaded thereon so as to extend the full diameter thereof at substantially a right angle to tha aforedescribed centerline of the cylindrical member 28. Further, the tension rods 106 and 108 in accord with the best mode embodiment of the invention are secured in the aforedescribed manner approximately three inches from the top of the cylindrical member 28 in the case of the tension rod 106 and approximately three inches from the bottom of the cylindrical member 28 in the case of the tension rod 108.

A description will next be had herein of the redirection means 24 of the narrow stationary impact attenuation system 10. For this purpose, reference will be had in particular to FIGS. 2,7–10 and 15 of the drawing. As set forth herein previously, the function of the redirection means 24, as the name thereof implies, is to effectuate the redirection of an errant vehicle into the traffic flow direction when the narrow stationary impact attenuation system 10 is struck under side impact conditions thereby. The redirection means 24, as noted previously herein, is assisted in this regard by the lateral delection means 20 of the narrow stationary impact attenuation system 10.

Figure 8:
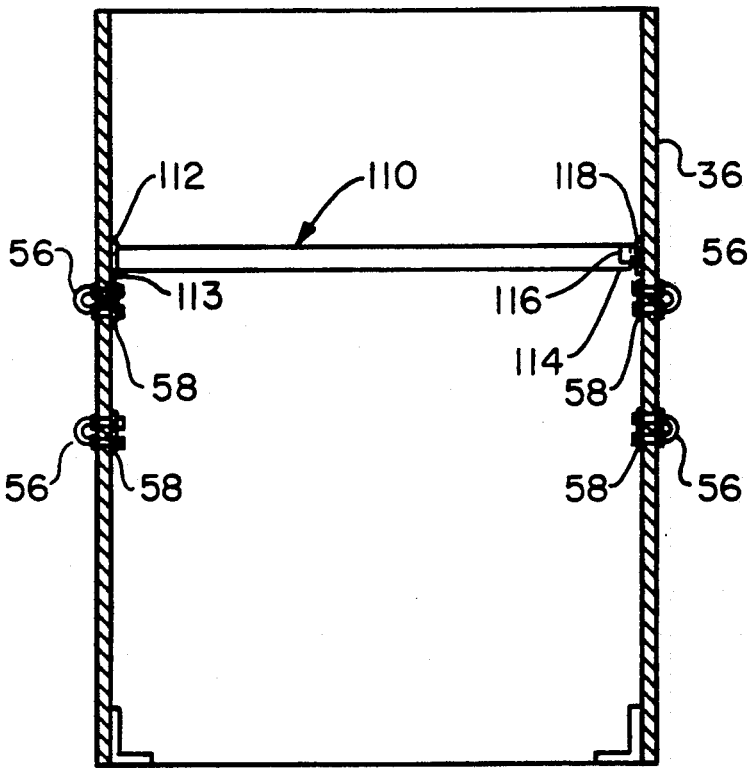
FIG. 8 is a cross-sectional view taken along the line 8—8 in FIG. 7 of yet another one of the multiplicity of cylindrical members that collectively comprise the crash cushion of a narrow stationary impact attenuation system constructed in accordance with the present invention.
Figure 9:
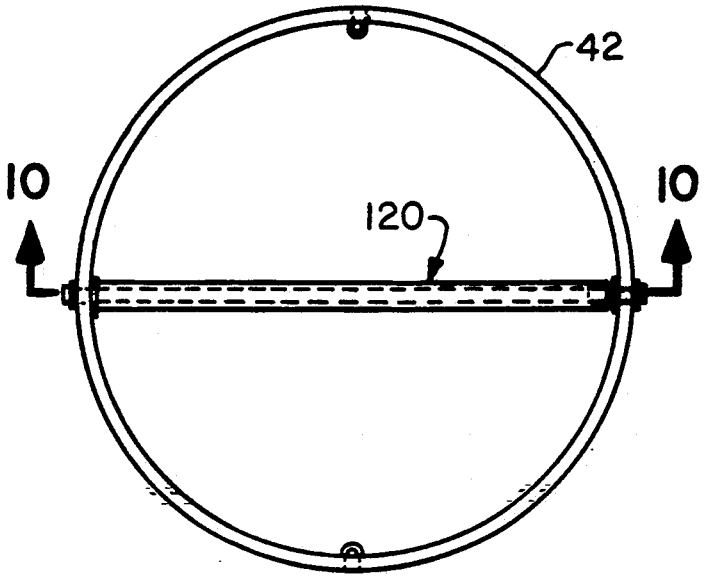
FIG. 9 is a plan view of yet still another one of the multiplicity of cylindrical members that collectively comprise the crash cushion of a narrow stationary impact attenuation system constructed in accordance with the present invention.

Continuing with the description thereof, the redirection means 24, as best understood with reference to FIG. 2 of the drawing, is cooperatively associated in a manner yet to be described with the cylindrical members 36, 38, 40 and 42 of the crash cushion means 12 of the narrow stationary impact attenuation system 10. More specifically, in accord with the best mode embodiment of the invention, the redirection means 24 consists of a diametrically placed compression pipe with which each of the cylindrical members 36, 38 and 40 of the crash cushion means 12 is suitably provided and a compression-tension pipe with which the cylindrical member 42 of the crash cushion means 12 is likewise suitably provided. Inasmuch as each of the diametrically placed compression pipes 36, 38 and 40 which is suitably provided is identical both in structure and function, a description thereof will now be set forth with reference to FIG. 8 of the drawing wherein the cylindrical member 36 of the crash cushion means 12 is illustrated. Referring, therefore, to FIG. 8 of the drawing, as best understood with reference thereto the cylindrical member 36, which for purposes of this description is to be considered represntative of the cylindrical members 38 and 40 also, is suitably provided with the diametrically placed compression pipe that is denoted generally by the reference numeral 110. In accord with the best mode embodiment of the invention, the diametrically placed compression pipe 110 is suitably supported within the cylindrical member 36 such as to extend from one side of the interior thereof to the other side of the interior thereof. Moreover, the diametrically placed compression pipe 110 preferably is positioned so as to be spaced approximately thirty-two inches from the base, as viewed with reference to FIG. 8, of the cylindrical member 36. The compression pipe 110 is diametrically placed within the cylindrical member 36 such as to have one end thereof, i.e., the end thereof denoted by the reference numeral 112 in FIG. 8 of the drawing, suitably secured to the inside surface of the cylindrical member 36 such as by being welded to a backplate denoted by the reference numeral 113 which in turn is welded to the inside surface of the cylindrical member 36. The other end of the compression pipe 110, i.e., that denoted by the reference numeral 114, is supported for movement on a nipple, denoted by the reference numeral 116, which in accord with the best mode embodiment of the invention is secured such as by being welded thereto to a backplate denoted by the reference numeral 118 which in turn preferably is secured to the inside surface of the cylindrical member 36 such as by being welded thereto.

Figure 10:
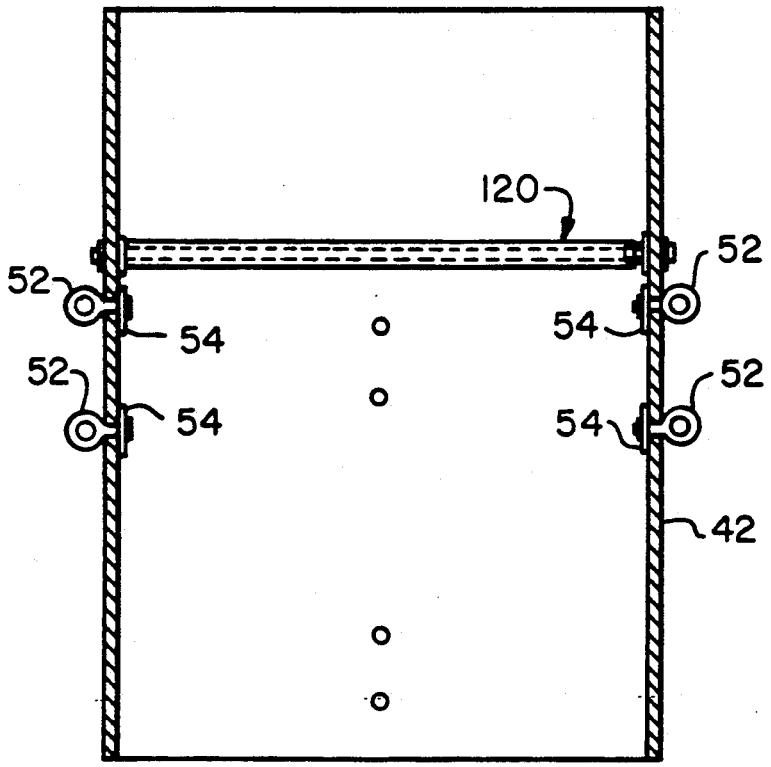
FIG. 10 is a cross-sectional view taken along the line 10—10 in FIG. 9 of yet still another one of the multiplicity of cylindrical members that collectively comprise the crash cushion of a narrow stationary impact attenuation system constructed in accordance with the present invention.

Completing the description of the redirection means 24, the cylindrical member 42, as best understood with particular reference to FIGS. 10 and 15 of the drawing, is suitably provided with the compression-tension pipe, which is denoted generally by the reference numeral 120. The compression-tension pipe 120, in accord with the best mode embodiment of the invention, is suitably provided within the cylindrical member 42 so as to extend the full width thereof. Moreover, the compression-tension pipe 120 preferably is secured in place within the cylindrical member 42 so as to be spaced approximately thirty-two inches from the base, as viewed with reference to FIG. 10, of the cylindrical member 42. Referring to FIG. 15 of the drawing, it can be seen therefrom that the compression-tension pipe 120 includes a tension rod denoted by the reference numeral 122 which spans the width of the cylindrical member 42 and projects outwardly therefrom on either side thereof whereby the respective ends 124, 126 of the tension rod 122 are suitably fastened in place through the use of any conventional form of fastening means such as conventional nuts 128, 130 threaded in known fashion on the respective ends 124, 126 of the tension rod 122 and with a washer 132 being interposed therebetween. Encircling the tension rod 122 in turn is a compression pipe 134, the function and structure thereof being essentially the same as that of the compression pipe 110 with which each of the cylindrical members 38, 38 and 40 is suitably provided in the manner described hereinbefore. Namely, the compresssion pipe 134 is positioned within the cylindrical member 42 so that the tension rod 122 passes therethrough and so that one end of the compression pipe 134, i.e., the end thereof denoted by the reference numeral 136 in FIG. 15 of the drawing, is suitably secured to the inside surface of the cylindrical member 42 such as by being welded to a backplate denoted by the reference numeral 138 which in turn is welded to the inside surface of the cylindrical member 42. The other end of the compression pipe 134, i.e., that denoted by the reference numeral 140, is supported for movement on a nipple, denoted by the reference numeral 142, which in accord with the best mode embodiment of the invention, is secuired such as by being welded thereto to a backplate denoted by the reference numeral 144 which in turn preferably is secured to the inside surface of the cylindrical member 42 such as by being welded thereto.

There will now be set forth herein a description of the final component of the narrow stationary impact attenuation system 10; namely, the base means 26. For this purpose reference will be had in particular to FIG. 1 of the drawing. In accord with the best mode embodiment of the invention, the narrow stationary impact attenuation system 10 of the present invention is preferably emplaced upon a sturdy foundation. This foundation may takethe form of the normal highway surface if the latter is composed of a conventional concrete base. Otherwise, there exists a need to provide such a concrete base, as shown in FIG. 1 wherein the concrete base is denoted by the reference numeral 146, on which the narrow stationary impact attenuation system 10 is suitably emplaced. The reason why such a concrete base or other equivalent surface is required is in order to prevent the narrow stationary impact attenuation system 10 from digging into the surface on which it is emplaced when struck by an errant vehicle which may be traveling at up to sixty miles per hour and which may weigh up to 4500 pounds. To this end, in accord with the best mode embodiment of the invention the concrete base 146 at the front and rear of the narrow stationary impact attenuation system 10 preferably is made to be about twelve inches thick whereas under the crash cushion means 12 the concrete base 146 is made to be approximately six inches thick. At the front and rear of the narrow stationary impact attenuation system 10 the concrete base 146 is made to be thicker in order to provide the necessary support to effectuate the tiedown thereat of the narrow stationary impact attenuation system 10.

Further, as has been described previously hereinbefore, a pair of skid rails denoted by the reference numerals 98 and 100, only one of which, i.e., skid rail 100, being visible in FIG. 1, are suitably positioned on either side of the concrete base 146 so as to extend the full length thereof and such that the cylindrical members 28,30,32,34,36,38,40 and 42 of the crash cushion means 12 as well as the pipe-like members 62,64 and 66 of the backup means 16 are suitably positioned thereon for movement relative thereto when the narrow stationary impact attenuation system 10 is struck by an errant vehicle.

Thus, in accordance with the present invention there has been provided a new and improved form of stationary impact attenuation system operable to reduce the severity of vehicular collisions with immovable objects. The stationary impact attenuation system is particularly suited for employment as a stationary system at narrow hazard sites to afford protection to immovable objects from otherwise being struck by an errant vehicle. In accord with the present invention, the narrow stationary impact attenuation system is operative when struck headon by an errant vehicle weighing up to 4500 pounds and traveling at a speed of up to sixty miles per hour to entrap the errant vehicle striking the system. In addition, the narrow stationary impact attenuation system is operative other than when struck headon by an errant vehicle weighing up to 4500 pounds and traveling up to sixty miles per hour to redirect the errant vehicle striking the system under side impact conditions into the traffic flow deirection. Moreover, in accordance with the present invention the narrow stationary impact attenuation system is capable of satisfying the applicable impact performance standards as outlined in NCHRP Report 230. Also, the narrow stationary impact attenuation system of the present invention is advantageously characterized in that the use thereof is not unduly limited because of considerations of terrain, etc. Furthermore, in accord with the present invention the narrow stationary impact atenuation system is characterized by the fact that when struck by an errant vehicle there is no flying debris associated with the crash event. Finally, the narrow stationary impact attenuation system of the present invention is capable of being constructed of readily available materials, and is inexpensive to repair after having been struck by an errant vehicle.

While only one embodiment of my invention has been shown, it will be appreciated that modifications thereof, some of which have been alluded to hereinbefore, may be readily made thereto by those skilled in the art. I, therefore, intend by the appended claims to cover the modifications which fall within the true spirit and scope of my invention.

What is claimed is:

1. A narrow stationary impact attenuation system for reducing the severity of vehicular collisions occasioned by an errant vehicle striking an immovable object at narrow hazard sites comprising:

a. crash cushion means operative for cushioning the shock of an errant vehicle striking the narrow stationary impact attenuation system;

b. lateral stability means extending the length of said crash cushion means on either side thereof and operative for providing lateral stability to said crash cushion means;

c. backup means positioned in juxtaposed relation to said crash cushion means at the rear thereof and operative to provide support for said crash cushion means at the rear thereof;

d. support means positioned in juxtaposed relation to said crash cushion means at the front thereof to anchor said lateral stability means at the front of said crash cushion means;

e. lateral deflection means mounted in supported relation at selected positions relative to said crash cushion and operative to limit the amount of lateral deflection that said crash cushion means is permitted to undergo when the narrow stationary impact attenuation system is struck by an errant vehicle under side impact conditions;

f. vehicle anti-vaulting means mounted in supported relation at selected positions relative to said crash cushion means and operative for preventing an errant vehicle that strikes the narrow stationary impact attenuation system from vaulting over or submarining under the narrow stationary impact attenuation system;

g. redirection means mounted in supported relation at selected positions relative to said crash cushion means and operative to effect in combination with said lateral stability means and said lateral deflection means the redirection into the traffic flow direction of an errant vehicle striking the narrow stationary impact attenuation system under side impact conditions; and h. base means operative as the surface on which the narrow stationary impact attenuation system is emplaced.

2. The narrow stationary impact attenuation system as set forth in claim 1 wherein said backup means comprises a tubular structure that is also operative to provide support for said lateral stability means at the rear of the narrow stationary impact attenuation system.

3. The narrow stationary impact attenuation system as set forth in claim 1 wherein said lateral stability means comprises a plurality of cable-like members that are suitably connected to said crash cushion means on either side thereof.

4. The narrow stationary impact attenuation system as set forth in claim 3 wherein said support means comprises an anchor support for said cable-like members.

5. The narrow stationary impact attenuation system as set forth in claim 1 wherin said crash cushion means comprises a multiplicity of cylindrical members that are of predetermined width and of different preselected thicknesses.

6. The narrow stationary impact attenuation system as set forth in claim 5 wherein said lateral deflection means comprises a plurality of lateral deflection limiters that are cooperatively associated with selected ones of said multiplicity of cylindrical members.

7. The narrow stationary impact attenuation system as set forth in claim 5 wherein said vehicle antivaulting means includes a plurality of box beam-like members that are cooperatively associated with selected ones of said multiplicity of cylindrical members.

8. The narrow stationary impact attenuation system as set forth in claim 7 wherein said vehicle antivaulting means further includes a plurality of tension members that are cooperatively associated with selected ones of said multiplicity of cylindrical members.

9. The narrow stationary impact attenuation system as set forth in claim 5 wherein said redirection means includes a plurality of compression members that are cooperatively associated with selected ones of said multiplicity of cylindrical members.

10. The narrow stationary impact attenuation system as set forth in claim 9 wherein said redirection means further includes a compression-tension member that is cooperatively associated with a selected one of said multiplcity of cylindrical members.

11. The narrow stationary impact attenuation system as set forth in claim 1 wherein said base means comprises a concrete road surface.

* * * * *